US005830350A

United States Patent [19]

Voss et al.

[11] Patent Number: 5,830,350

[45] Date of Patent: Nov. 3, 1998

[54] POOL SKIMMER BASKET

[76] Inventors: Gene A. Voss, 4227 Centergate, San Antonio, Tex. 78217; William Don Price, 8921 Fair Oaks Pky., Fair Oaks, Tex. 78015

[21] Appl. No.: 813,078

[22] Filed: Mar. 7, 1997

[51] Int. Cl.[6] ..... E04H 4/16

[52] U.S. Cl. ..... 210/169; 210/472; 4/290

[58] Field of Search ..... 4/290; 210/169, 210/232, 416.2, 472

[56] References Cited

U.S. PATENT DOCUMENTS

| | | | |
|---|---|---|---|
| 3,252,576 | 5/1966 | Miller | 210/169 |
| 3,306,448 | 2/1967 | Baker | 210/169 |
| 3,469,700 | 9/1969 | Johnson | 210/169 |
| 3,555,574 | 1/1971 | Stanwood | 210/169 |
| 3,628,664 | 12/1971 | Stanwood | 210/169 |
| 4,154,679 | 5/1979 | Farage | 210/169 |
| 4,725,352 | 2/1988 | Haliotis | 210/169 |
| 5,418,983 | 5/1995 | Garguillo | 4/290 |
| 5,535,455 | 7/1996 | Liu | 4/290 |

*Primary Examiner*—Peter A. Hruskoci
*Assistant Examiner*—Theodore M. Green
*Attorney, Agent, or Firm*—David G. Henry

[57] ABSTRACT

The invention is of an improved pool skimmer basket which provides means by which water is vented through the basket, even when the strainer orifices are clogged. Applicant's basket is fitted with a centrally positioned vent tower which extends from the bottom of the basket, through its interior space, and slightly above the top rim of the basket. When the basket requires servicing, it may easily be removed from a skimmer well without shutting off the pool's vacuum system. The vent orifices in the vent tower allow water to pass into the hollow of the vent tower, and out through the bottom of the basket thereby bypassing the clogged strainer orifices and relieving the suction against the basket. Ease of removing the basket prevents handle and basket breakage and with it the need for the pool owner to "fish" the basket (with its unknown and, perhaps, dangerous contents) from a skimmer well.

1 Claim, 3 Drawing Sheets

POOL SKIMMER BASKET

BACKGROUND OF THE INVENTION

1. Field of The Invention

Applicant's invention relates to filtration devices, and more particularly to swimmer pool filtration equipment.

2. Background Information

Most modern swimming pools have circulation and filtration systems, one component of which is known as a "skimmer." A skimmer is a relatively simple structure which involves a skimmer well positioned adjacent the pool with the top of the well lying slightly below the normal water level of the pool. A conduit extends between the skimmer well wall and the pool wall, and opens, respectively, at points near the top of the skimmer well and near, but just below the normal water level in the pool.

At the bottom of the skimmer well is an orifice through which water in the skimmer well is drawn by a vacuum pump, which water is returned to the pool in an endless cycle. Over time, all of the water in the pool will pass through the skimmer, and, under ordinary conditions, items floating on top of the water will eventually flow into the skimmer well.

A highly perforated skimmer basket is sized and shaped to sit within the skimmer well and serves as a strainer to trap leaves or other items which flow into the skimmer.

A frequent problem encountered by pool owners involves a skimmer basket which is completely (or nearly completely) filled with debris. When this occurs, removing the skimmer basket for cleaning becomes very difficult, unless the owner shuts off the pool's vacuum pump. As a practical matter, most pool owners try to avoid the extra step of shutting off the vacuum pump.

With substantially all of the basket's perforations being obscured, the pool owner must overcome the substantial force exerted on the basket by the vacuum pump and remove the basket "by brute force." While this is not impossible, a very common result is that the basket and/or its handle breaks. This is true, in part, because skimmer baskets are almost universally of plastic construction. Even if metal baskets were used, the force required to extract the basket would still be substantial, and the metal baskets would rust, particularly in face of pool chemicals. As a practical matter, plastic skimmer baskets are here to stay, and presently available skimmer baskets will continue to break under the circumstances just described.

Removing a skimmer basket without the benefit of a handle or other above-well level grasping device can be very unpleasant, if not dangerous. Leaves and insects are not the only things which flow into pool skimmers. Many pool owners report finding dead rodents in their skimmers as well as snakes (both dead and alive). Thus, groping around in a skimmer well to "fish out" a broken skimmer basket is not an attractive option to most pool owners.

SUMMARY OF THE INVENTION

It is an object of the present invention to provide an improved pool skimmer basket.

It is another object of the present invention to provide novel means by suction against a pool skimmer basket is partially relieved, even when the basket is filled with debris.

It is another object of the present invention to provide an improved pool skimmer basket having vent means which permit continued circulation of water through the pool skimmer basket, even when all filtration perforations are clogged.

In satisfaction of these and related objectives, Applicant's present invention provides an improved pool skimmer basket. Applicant's basket, in its preferred embodiment, exhibits a centrally positioned "vent tower" which extends from the bottom of the basket to a point at least slightly above the upper rim of the basket. The vent tower is a hollow structure with small perforations or vent orifices dispersed along its length. At least one such vent orifice must reside slightly above the level of the upper rim of the basket to insure that an orifice lies above the water level in the skimmer well. This both reduces the likelihood that debris will obstruct all of the vent tower vent orifices (which is unlikely as will be discussed below) and allows water to exit the vent tower as the basket is withdrawn from the well to facilitate such withdrawal.

The vent tower is attached to the basket whereby an open lower end of the vent tower opens directly to the outside of the basket at the bottom thereof. Thus, water which is drawn under force of the pool's vacuum pump is drawn, not only though the basket perforations, but through the vent orifices. The latter water exits the basket structure through the lower end of the vent tower.

Through in-field evaluation, it has been determined that the orifices of the vent tower are unlikely, in all but the most extreme cases, to become clogged with debris, even when a layer of debris covers all or most of the perforations on the basket side and bottom portions. The currents formed as water flows through the vent orifices in the vent tower and down through its lower opening tend to repel debris from the area immediately surrounding the vent tower. Thus, debris tends to collect, even in multiple layers, over the perforations in the basket in preference to collecting around the vent tower. This tendency greatly enhances the utility of the modified skimmer basket.

So long as the vent orifices of the vent tower remain unobscured, a pool owner or service person will be able to easily remove a skimmer basket needing emptying, even with the vacuum pump still running. This is because the venting effect of the vent tower will relieve much of the force of the suction which would otherwise work against removal of the basket and tend to promote handle breakage, etc. Because water, and ultimately air, is allowed to flow through the vent orifices of the vent tower as the basket is withdrawn from the skimmer well, the person servicing the skimmer neither has to directly compete with the force of the vacuum pump to remove the basket, nor must lift the weight of the basket which will be filled with both debris and water.

Applicant's approach to the problem described above is certainly simple, but it is equally unobvious. Applicant's informal surveys of pool owners reveal a pervasiveness of the problems of broken skimmer baskets (which were broken when straining against the suction of the pool's vacuum pump when the basket was clogged) and the often resulting unpleasant experience of "fishing" the basket out of the skimmer well. Despite this well-known and long-existing problem, and a readily apparent market for a solution, no one has presented a viable, cost-effective solution such as Applicant here provides.

DETAILED DESCRIPTION OF THE PREFERRED EMBODIMENT

Figure 1:
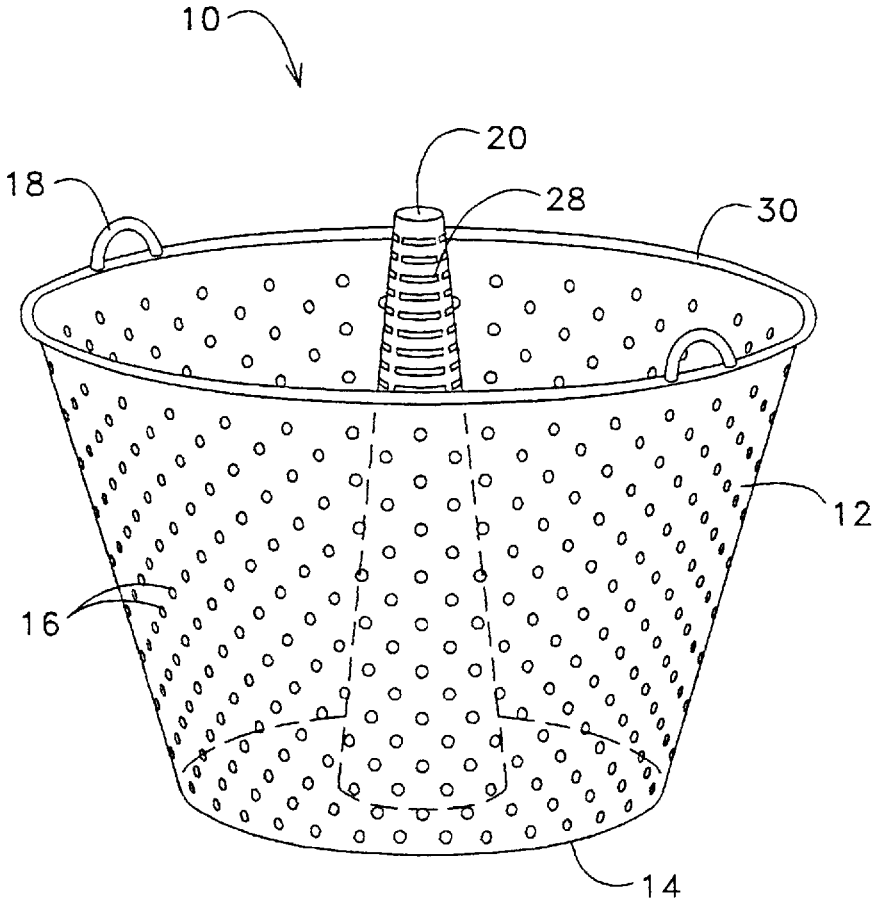
FIG. 1 is a perspective view of the preferred embodiment of Applicant's improved Pool Skimmer Basket.

Referring to FIG. 1, Applicant's improved pool skimmer basket is identified generally by the reference numeral 10.

While most baskets 10 are unitary structures, for discussion purposes, basket 10 can be divided into two primary portions—the wall or side portion 12 and a bottom portion 14. Both side portion 12 and bottom portion 14 are perforated by numerous strainer orifices 16. As with any skimmer basket, strainer orifices 16 allow water as drawn through the pool skimmer (not separately shown) to pass through the basket 10, but catch most solids in a strainer-like manner. Basket 10 is removed from a skimmer well using a handle (not shown) which is connected to handle eyes 18.

Figure 2:
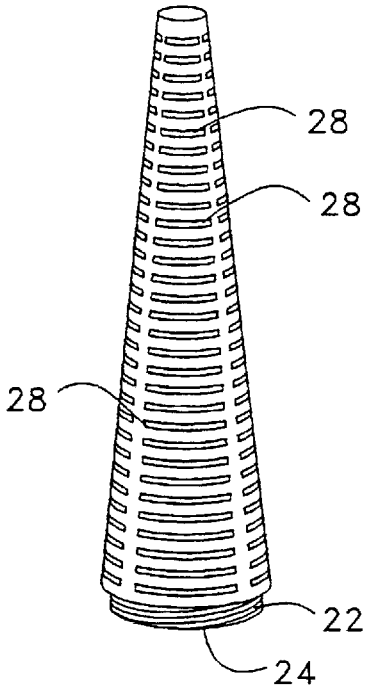
FIG. 2 is an elevational view of the vent tower of the Pool Skimmer Basket of FIG. 1.
Figure 3:
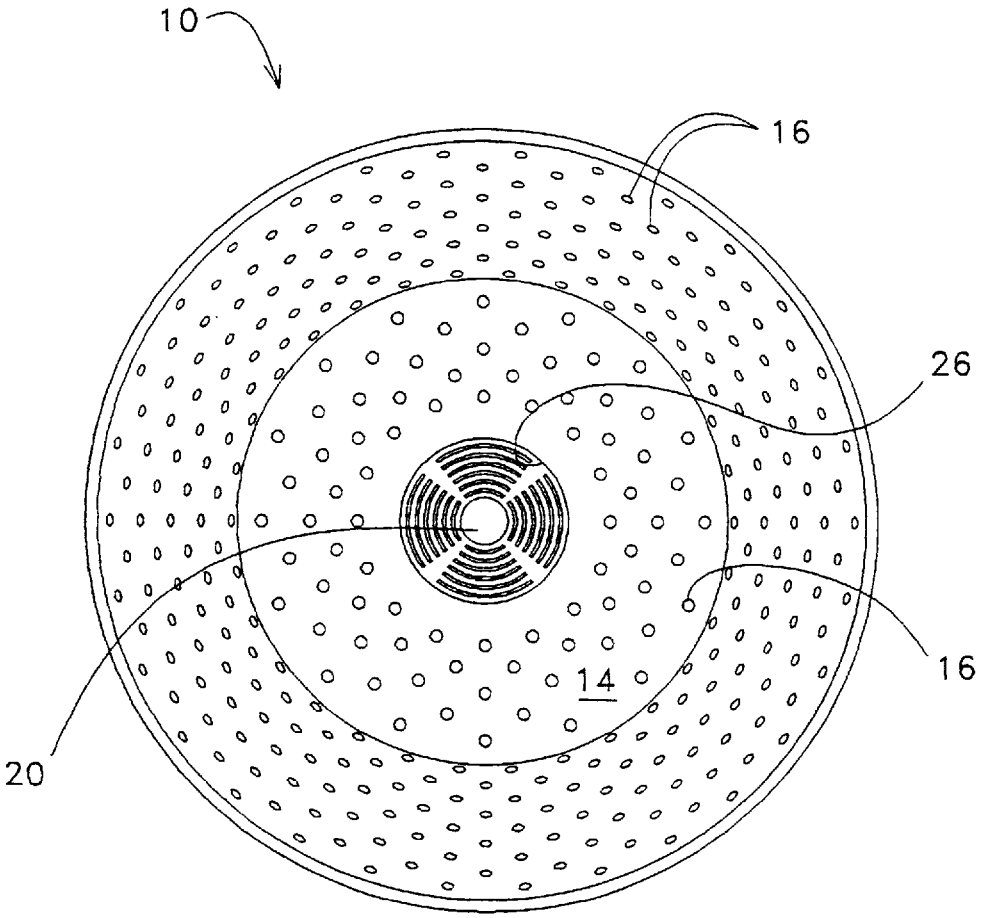
FIG. 3 is bottom plan view of the basket of FIG. 1.

Referring to FIGS. 1, 2 and 3, extending upwardly into the interior space of basket 10 from the bottom portion 14 is a vent tower 20. Vent tower 20 is a hollow structure which includes a threaded annulus 22 at its bottom end 24. The bottom end 24 of vent tower 20 opens into the interior hollow of vent tower 20. Vent tower 20, in the preferred embodiment, is threadingly engaged with basket 10 at a complimentarily threaded opening 26 in the bottom portion 14 of basket 10. Of course, other engagement schemes, including bayonetted mounts, snap-fit structures, etc. will suffice.

Vent tower 20 is highly perforated with a number of vent orifices 28. Vent tower 20 should be of a length that it extends above the level of the basket rim 30, and at least some of the vent orifices 28 should be positioned whereby they will be above the level of the basket rim 30 when engaged with basket 10. The basis for this is discussed above in the Summary of the Invention.

In the preferred embodiment, vent tower 20 is removable from basket 10 for allowing the use of certain skimmer accessories (pool sweeper attachments, most notably) which require a flush mating between a plate member and the basket rim 30 of basket 10, which mating the vent tower 20 would likely obstruct if left in place.

The over-all conical shape of vent tower 20 as shown in the drawings is merely the preferred embodiment—the result of molding efficiencies. Any structure of any shape which provides fluid communication through a plurality of vent orifices between space interior to basket 10 (other than as are positioned on the side portion 12 or bottom portion 14 of basket 10) and space outside of basket 10 will satisfy the functional requirements of vent tower 20.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A pool skimmer component comprising:

a skimmer basket member sized and shaped for nesting reception within a pool skimmer well, said skimmer basket having a basket bottom portion and a basket side portion, said basket side portion extending upwardly from the periphery of said basket bottom portion and terminating as a basket side portion rim;

a vent member, said vent member being formed of an elongate vent body having a first vent member end and a second vent member end, said vent member defining within said vent body and between said first vent member end and said second vent member end a vent member interior hollow, said vent body having one or more vent orifices extending through said vent body between said vent member interior hollow and space exterior to said vent member, at least one of said vent orifices being positioned whereby, when said first vent member end is attached to said basket bottom portion, said at least one said vent orifice resides at a point lying at a greater linear distance from said basket bottom portion than said basket side portion rim resides from said basket bottom portion when measured in parallel with the longitudinal axis of said vent member, said first end of said vent member having an exit orifice which opens to said interior hollow, said vent member being attached to said basket bottom portion whereby said exit orifice is also open to space outside of said skimmer basket member.

* * * * *